US007172020B2

(12) United States Patent
Tseytlin

(10) Patent No.: US 7,172,020 B2
(45) Date of Patent: Feb. 6, 2007

(54) OIL PRODUCTION OPTIMIZATION AND ENHANCED RECOVERY METHOD AND APPARATUS FOR OIL FIELDS WITH HIGH GAS-TO-OIL RATIO

(75) Inventor: Simon Tseytlin, Middle Village, NY (US)

(73) Assignee: Tseytlin Software Consulting Inc., Middle Village, NY (US)

( * ) Notice: Subject to any disclaimer, the term of this patent is extended or adjusted under 35 U.S.C. 154(b) by 317 days.

(21) Appl. No.: 10/983,308

(22) Filed: Nov. 8, 2004

(65) Prior Publication Data

US 2005/0194131 A1 Sep. 8, 2005

Related U.S. Application Data

(60) Provisional application No. 60/549,992, filed on Mar. 5, 2004.

(51) Int. Cl.
*E21B 47/00* (2006.01)

(52) U.S. Cl. ..... 166/250.07; 166/250.15

(58) Field of Classification Search ..... None
See application file for complete search history.

(56) References Cited

U.S. PATENT DOCUMENTS 4,442,710 A * 4/1984 Meng ..... 73/152.31
5,105,889 A 4/1992 Misikov
5,752,570 A 5/1998 Shaposhnikov
5,871,047 A * 2/1999 Spath et al. ..... 166/250.01
5,967,234 A 10/1999 Shaposhnikov

OTHER PUBLICATIONS

Vogel. Inflow Performance Relationships for Solution-Gas Drive Wells. Journal of Petroleum Technology, Jan. 1968, pp. 83-92.
Klins Ma. Inflow Performance Relationships for Damaged or Improved Wells Producing Under Solution-Gas Drive. Journal of Petroleum Technology, Dec. 1992, pp. 1357-1363.

* cited by examiner

*Primary Examiner*—Frank Tsay
(74) *Attorney, Agent, or Firm*—Boris Leschinsky

(57) ABSTRACT

A method for optimizing oil production rate from an oil well with high gas-to-oil ratio is disclosed to include modeling an Inflow Performance Relationship curve and calculating an optimal level of bottomhole pressure to be higher than zero. Maintaining the bottomhole pressure at that calculated optimum level by using a bottomhole tool of the invention or other known means such as gas injection provides for maximum oil recovery from a given well. The bottomhole tool includes a multi-stage flow resistor and a needle moved in and out of the resistor by a spring-biased piston responsive to a difference in pressure between a bottomhole pressure and a pipe pressure. Automatic adjustment of the bottomhole pressure is maintained over a wide range of operating parameters throughout the life of the well.

19 Claims, 9 Drawing Sheets

OIL PRODUCTION OPTIMIZATION AND ENHANCED RECOVERY METHOD AND APPARATUS FOR OIL FIELDS WITH HIGH GAS-TO-OIL RATIO

CROSS-REFERENCE DATA

Priority is claimed herein from a U.S. Provisional Application No. 60/549,992 by the same inventor, as filed Mar. 5, 2004 and entitled "OIL PRODUCTION OPTIMIZATION AND ENHANCED OIL RECOVERY METHOD AND APPARATUS FOR OIL FIELDS WITH HIGH GOR", incorporated herein in its entirety by reference.

BACKGROUND OF THE INVENTION

The present invention relates generally to a method and devices for increasing the production of oil. More specifically, the method and the bottomhole tool of the invention provide for maintaining the bottomhole pressure at a level optimum for maximizing oil production in a well with high gas-to-oil ratio (GOR). The most advantageous are of implementation of the present invention is in wells with high GOR defined as GOR greater than 600 cubic feet per barrel. In these wells the method and the tool of the invention can be used when the bottomhole pressure is lower than the bubble point pressure as well as in all cases when the gas cone has appeared such as in fountain, gas lift, and pump regimes of oil production.

Optimization of oil production has been a goal of many methods and devices of the prior art. Generally speaking, the bottomhole behavior of oil mixed with gas and some other ingredients such as water, etc. has been described in a series of mathematical equations by Muskat. One specific publication of Muskat is incorporated herein by reference in its entirety and describes the mathematical model of oil reservoir: Muskat M. "The Production Histories of Oil Producing Gas-Drive Reservoirs", published in the Journal of Applied Physics in March of 1945, p.147–159.

For illustration purposes, a one-dimensional axis-symmetrical system of Muskat equations with corresponding PVT characteristics of fluid and dependencies of relative permeability $K_{ro}$, $K_{rg}$ from liquid saturation ($S_o$) can be described as follows:

$$\frac{1}{r}\frac{\partial}{\partial r}\left(r\frac{k_{ro}}{\mu_o B_o}\frac{\partial p}{\partial r}\right) = -158.064\frac{\phi}{k}\frac{\partial}{\partial t}\left(\frac{S_o}{B_o}\right)$$

$$\frac{1}{r}\frac{\partial}{\partial r}\left[r\left(\frac{k_{rg}}{\mu_g B_g} + \frac{Rs}{5.615}\frac{k_{ro}}{\mu_o B_o}\right)\frac{\partial p}{\partial r}\right] = -158.064\frac{\phi}{k}\frac{\partial}{\partial t}\left(\frac{S_g}{B_g} + \frac{S_o}{B_o}\frac{Rs}{5.615}\right)$$

where: P—pressure in formation; $S_o$—oil saturation in formation; $S_g$—gas saturation in formation; $R_s$—solution of gas in oil; $B_o$—oil formation volume factor; $B_g$—gas formation volume factor; $\mu_o$—oil viscosity; $\mu_g$—gas viscosity; Φ—formation porosity; K—formation permeability.

For practical purposes, Vogel had simplified the Muskat equations and adapted them to the calculations of oil producing formations. These equations are known as Vogel model and have subsequently been modified by others. One example of such publication is as follows: Vogel, *Inflow Performance Relationships for Solution-Gas Drive Wells*, as published in Journal of Petroleum Technology, January 1968, pp. 83–92, incorporated herein in its entirety by reference. Unfortunately, Vogel model does not work well in wells with high gas-to-oil ratio. According to Vogel, the dependency of oil rate production of bottomhole pressure is a constantly diminishing parabolic curve with a production peak at zero bottomhole pressure, see for example FIG. 2 of the above mentioned article. In other words, the lower the bottomhole pressure is, the higher is the oil rate production from the formation. This is a gross simplification of the bottomhole processes in the formation. In fact, if the bottomhole pressure falls below saturation pressure in case of high GOR, relative permeability coefficient by oil decreases because of gas saturation increase, which in turn is a result of gas being released from oil. Viscosity of so degassed oil also increases. This leads to a decrease of productivity index of formation. This phenomenon effects the oil production rate more than the increasing depression. As a result, decreasing of the bottomhole pressure below saturation pressure can lead to a decrease in oil production rate, rather than to its increase as predicted by Vogel's model, see FIG. 1. In some extreme cases, reliance on Vogel's model will cause a complete switch in production from oil to gas. There is a need therefore for a method allowing calculating the oil production rate in high GOR wells with better accuracy then that allowed by Vogel's model.

More specifically, the need exists for a method of calculating well parameters in an optimal regime that takes into account two opposing processes. The existence of this optimal regime is explained by two phenomena simultaneously affecting the current oil rate in two opposite directions in the skin layer. On one hand, reducing the bottomhole pressure (increasing depression in formation) leads to increased oil rate:

$$Q_{oil} \sim K\,(P,S_L)\cdot(P_{form}-P_{bottom}),$$

where $Q_{oil}$—oil rate; $K(P,S_L)$=(ko*h)/(mu*Bo)—production index; $P_{form}$—formation pressure; $P_{bottom}$—bottomhole pressure; ko—relative oil permeability; h—length perforation interval ; mu—oil viscosity ; Bo—oil formation volume coefficient; $S_L$—saturation of liquid).

On the other hand, it reduces the production index ($K(P, S_L)$, because gas dissolved in oil comes out of solution, reducing therefore relative oil permeability of formation. Production index is additionally decreased due to an increased viscosity of degassed oil, which also significantly decreases oil mobility.

Thus, as the bottomhole pressure is decreasing, at first the oil rate begins to increase due to the increase of depression in formation. But, beginning with a specific bottomhole pressure (from now on called optimal bottomhole pressure), the oil rate starts to decrease even though the depression increases further, which is contrary to widely known models of Vogel and Fitzkovich. The reason for it is that after reaching the optimal bottomhole pressure, the influence of decreasing production index becomes dominating. This phenomena can be explained by strong non-linear relationship between the relative oil permeability of formation and its oil saturation for most often used saturation values ($S_L$=0.5÷1.0).

Besides, degassed oil not only becomes more viscous, but also shrinks in volume, which together with gas in free form creates a blocking zone, preventing exit of oil from formation and reducing oil saturation here. Strong skin effect may appear in a near bottomhole zone. FIG. 5 illustrates this situation, in which the well 100 contains a wellhead choke 110 at the surface and a bottomhole tool 120 close to the bottomhole formation consisting of saturated oil reservoirs 150, water layer 180, and gas layer 170. Note the areas of gas cone 130, water cone 140 and viscous barriers of oil with low mobility 160.

As a supplemental consideration, decreasing bottomhole pressure further increases GOR because of increased relative gas permeability of formation. This causes gas to prematurely exit formation, which in turn accelerates falling of formation pressure and as a result reduces the ultimate oil recovery index.

The presence of a point of flow rate maximum on the IPR curve (and thus the optimal bottomhole pressure) may also be explained by presence of gas and/or water cones, which reduce the active oil inflow perforation interval, and expand the segments surrounded by gas and water cones, appearing and growing when the bottomhole pressure decreases. GOR also significantly increases in that case. FIG. 9 demonstrates a visible peak in oil rate on an actual IPR curve obtained from an oil well in a large Siberian oil field. The maximum oil flow rate is observed at a bottomhole pressure not equal to zero.

A further need exists for a bottomhole tool allowing adjustments in bottomhole pressure in a well. Many designs of bottomhole tools and methods of controlling the bottomhole pressure are known in the prior art. One of such devices is disclosed in U.S. Pat. No. 5,105,889. This device includes a set of axially vertically aligned pipes of different diameters and lengths, forming a multi-parameter hydrodynamic system. That system establishes a certain pre-calculated bottomhole pressure below the device, in order to decrease gas blockage of the near bottomhole zone of the oil formation and to provide a stable fluid flow to the surface. A forced fluid degassing takes place in the device, creating a two-phase gas-liquid emulsion in order to provide a sufficient fluid lift within the well. The device disclosed in this patent has however certain limitations. A pressure differential across the device depends on the calculated diametrical parameters of the pipes. That in turn corresponds to current values of the flow parameters in the formation. Such fixed dependency restricts the adaptability of the device to changing reservoir and well conditions.

Another method and device is disclosed in the U.S. Pat. No. 5,752,570. In accordance with this patent, the bottomhole pressure is automatically maintained higher than a current saturation pressure of the formation fluid with gas in the near bottomhole zone of the formation, regardless of fluctuations of fluid pressure in the formation. This is done in order to create fluid flow with minimum gas content. Once the bottomhole pressure decreases, the device automatically creates conditions for formation of a fluid flow into the device with an increased speed. Nearly mono-phase flow is transformed within the device into a finely dispersed gas-liquid two-phase flow, in order to provide its lift to the wellhead. The device disclosed in this reference automatically adjusts bottomhole pressure to a desired level, simultaneously providing a pressure drop, in order for the fluid to sustain degassing within the transforming area, according to the device inlet pressure at the bottomhole. However, in the process of oil field development, operational conditions change as well as the inflow performance curve corresponding to a current well operation. The sensing element of the device disclosed in this reference might no longer maintain the same optimal well operation, since its calibration is based on the previous well information parameters. Besides, calculations have proven that in some wells a space between the inner nozzle surface and the outer surface of the regulating cone of the device reduces to approximately 0.01 inch. With such a small space even a trace of sand in the fluid can jam the regulating unit and stop the well production. Since the pressure difference depending on the movement of the regulating cone has a non-linear characteristic and is a function of fixed power of the diameter of the adjustable cross-section, it impedes precise regulations.

A further example is disclosed in the U.S. Pat. No. 5,967,234 incorporated herein in its entirety by reference. Means for automatically adjusting the bottomhole pressure are described in this patent to include a spring-biased needle traveling inside a plurality of pipes of diminishing diameters. The space left between the needle and the corresponding pipe is available for oil flow and can be adjusted depending on the bottomhole pressure. Fixed geometry of the needle and the pipes makes this device limited in its field of use as changing parameters of the well require a broader range of adjustment of flow restriction then this device can provide.

The need exists therefore for a method and device with broad range of parameters that can be adjusted preferably from the surface of the well to bring the bottomhole pressure in agreement with the required values to maximize the production of oil from an oil well.

SUMMARY OF THE INVENTION

Accordingly, it is an object of the present invention to overcome these and other drawbacks of the prior art by providing a novel device and method for optimizing and maximizing the production of oil from an oil well, particularly an oil well with high GOR.

It is another object of the present invention to provide a method allowing calculating and maintaining the optimum value of bottomhole pressure required to maximize oil production and operating life duration of the well.

It is a further object of the present invention to provide a bottomhole tool allowing adjustment of bottomhole pressure from the surface in a wide range of formation conditions and throughout the life of the well without the need to replace the device.

It is yet a further object of the present invention to provide a bottomhole tool allowing adjustments of bottomhole pressure in a desired range such that the reliability of that tool is increased by providing larger values of clearances between the moving and non-moving parts of the tool. Increased reliability would depend on the resistance of the tool to jamming by sand and other particles present in oil flow.

The method of the invention is based on a mathematical model taking into account and accounting for all four key elements of oil production, including reservoir model, polyphase flow in pipes, flow through the bottomhole tool and flow through the surface choke. The mathematical model of the method of the invention allows calculating the optimum value for bottomhole pressure so that the oil rate production is maximized. Characteristics of all four elements are entered continuously into the equations and allow calculating and adjusting the value of bottomhole pressure throughout the life of the well and in various operating conditions thereof.

A multi-parameter bottomhole tool with flexible characteristic of pressure regulation is also proposed with a broader range of adjustments of the operating parameters then in the previously known devices. This is achieved by novel modifications of the tool's geometrical characteristics, i.e. by using of several sections with predetermined lengths and cross-sectional areas to create the noncircular channel for passing the fluid. The tool includes a series of pipes with decreasing diameters and a corresponding multi-stage piston- or spring-biased needle with diameters of stages selected to correspond to that of the pipes. Longitudinal movement of the needle along the length of the device allows changing of a greater number of parameters affecting the performance of the tool and therefore broadens the range of operation. This allows expansion of dynamic ranges of the controlled pressure drop and the fluid velocity without replacement the tool.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS OF THE INVENTION

The main concept of the method of the present invention lies in the discovery that there exists an optimal level of bottomhole pressure allowing to maximize the oil production rate and that this optimal bottomhole pressure does not necessarily have to be the lowest bottomhole pressure of the formation.

The method of the invention is based on an integrated mathematical model of the production process incorporating the following four key contributing factors defining the oil production: formation, multi-phase flow through pipes, surface choke flow and bottomhole tool flow. Calculations of these four factors will be described in more detail below.

Formation Calculations

First of all, according to the invention, basic Muskat equations describing the bottomhole formation and behavior of various parameters during the oil production operation are transformed in a way different from that of Vogel. Muskat equations were initially picked as a mathematical model, which describes basic processes of unsteady two-phase filtration in formation; with some simplifying assumptions as follows:

formation is one dimensional and there exists only radial flow;

porous media is isotropic and uniform;

gravity and capillary effects can be neglected;

compressibility of rock and water can be neglected;

constant pressure exists in both oil and gas phase.

These assumptions make it possible to describe the two-phase flow of oil and gas by the partial differential equations as follows:

$$\begin{cases} \frac{1}{r}\frac{\partial}{\partial r}\left(r\frac{K_{ro}}{\mu_o B_o}\frac{\partial P}{\partial r}\right) = -158.064\frac{\varphi}{K}\frac{\partial}{\partial t}\left(\frac{S_o}{B_o}\right) \\ \frac{1}{r}\frac{\partial}{\partial r}\left(r\left(\frac{K_{rg}}{\mu_g B_g} + \frac{Rs}{5.615}\frac{K_{ro}}{\mu_o B_o}\right)\frac{\partial P}{\partial r}\right) = -158.064\frac{\varphi}{K}\frac{\partial}{\partial t}\left(\frac{1-S_o-S_w}{B_g} + \frac{S_o}{B_o}\frac{Rs}{5.615}\right) \end{cases}$$

Zero flow condition on the outsize border of the zone is:

$$\left.\frac{\partial P}{\partial r}\right|_{r=r_e} = 0$$

On the wall of the well, a border condition is set based on known value of pressure or oil rate:

$$P|_{r=r_w} = P_w(t) \text{ or } \left.\frac{\partial P}{\partial r}\right|_{r=r_w} = F_w(t)$$

Initial conditions are also set as follows:

$$P(r,t)=P_0(r,0);\ S(r,t)=S_0(r,0);$$

Figure 2:
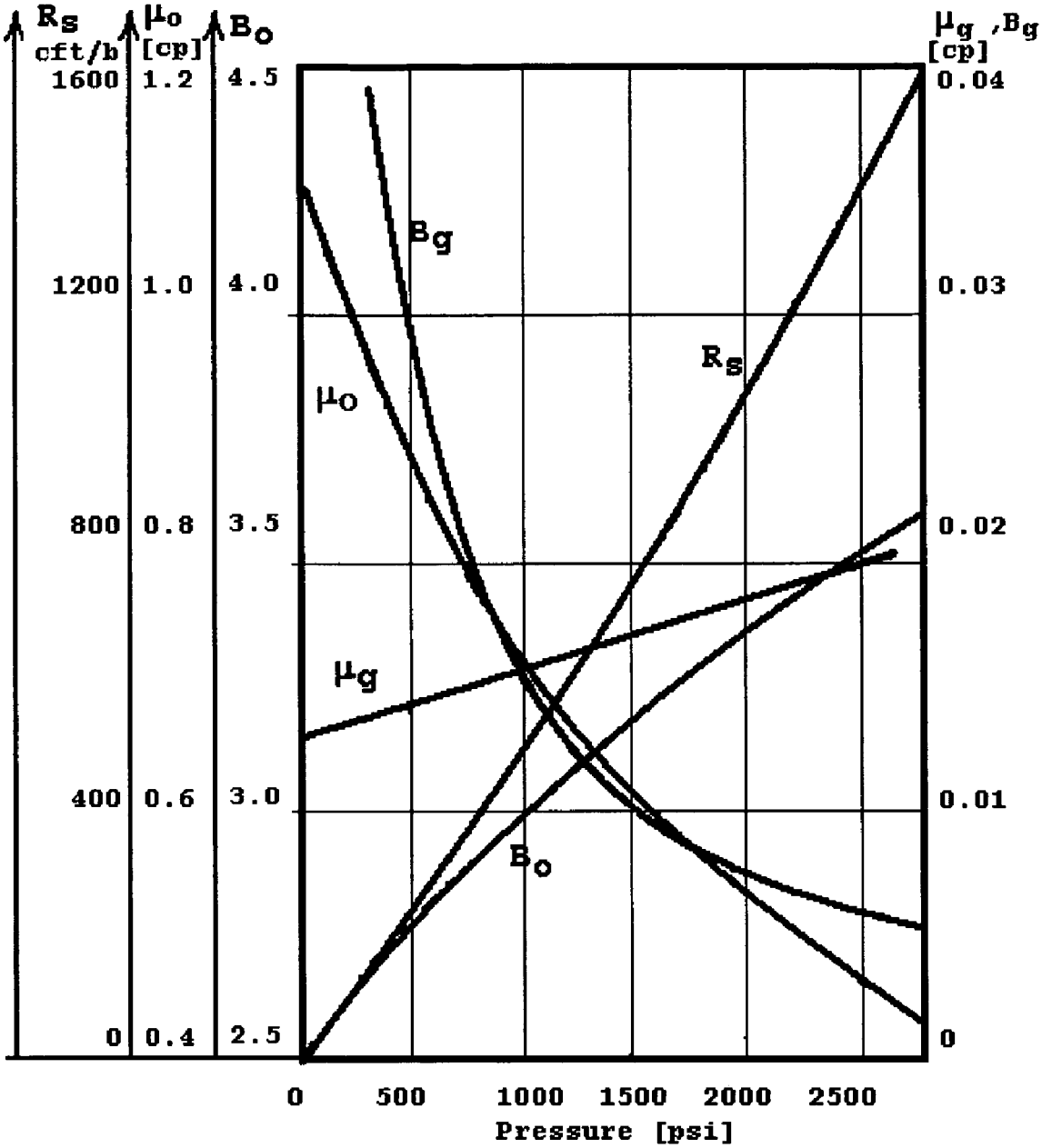
FIG. 2 is a sample PVT data needed for the method of the present invention.
Figure 3:
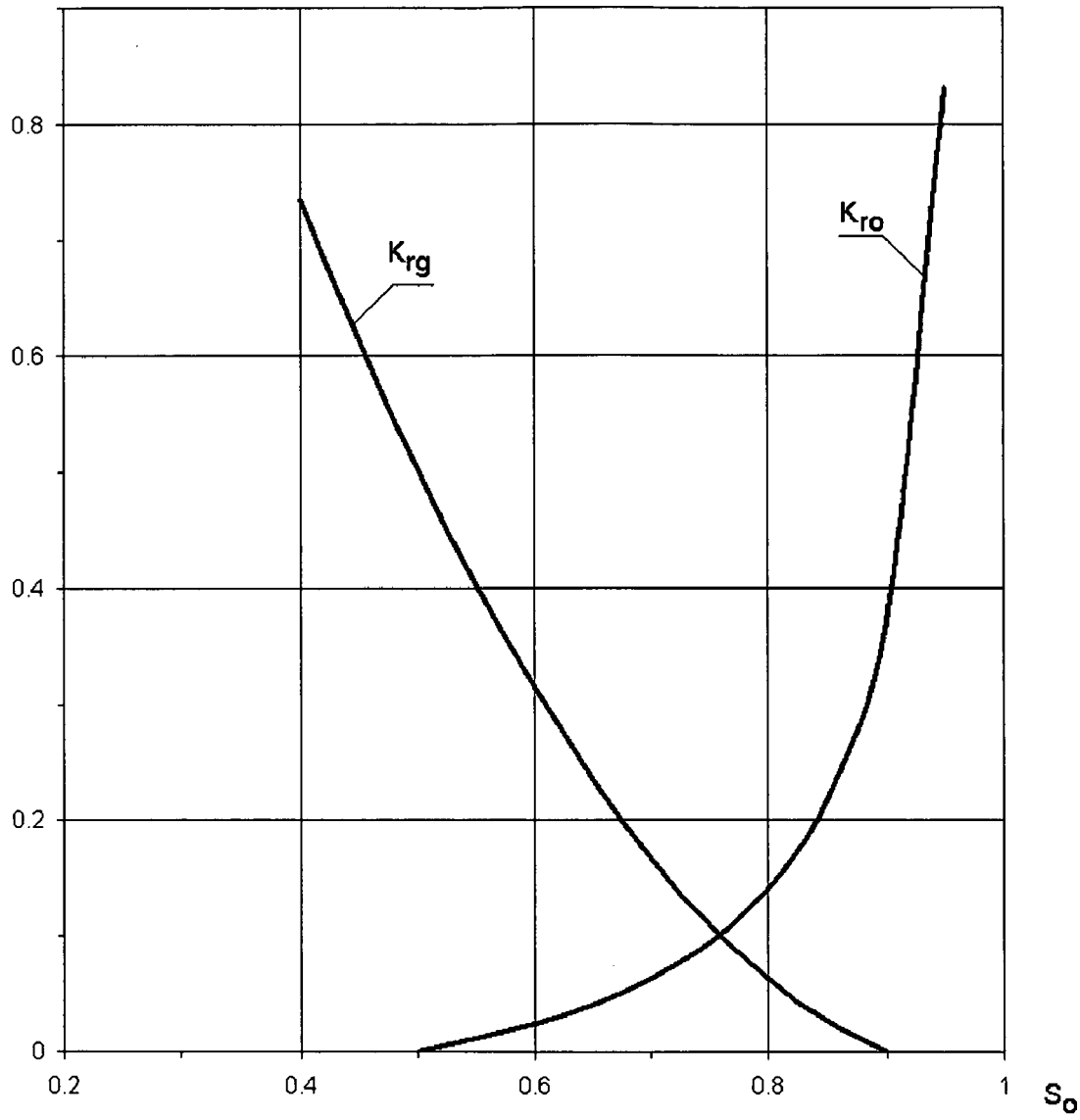
FIG. 3 is a sample chart showing relative permeability of oil and gas versus liquid saturation.

The above equations can be computed with available PVT data usually presented as a chart such as shown for example on FIG. 2 as well as taking into account the dependence of relative permeability of different phases from saturation (as shown for example on FIG. 3) and with the following other properties of reservoir: $\mu_o(P)$, $\mu_g(P)$, $B_o(P)$, $B_g(P)$, $R_s(P)$, $K_o(S_o)$, $K_g(S_g)$, K, Φ, $P_f$, $P_{bp}$, $r_w$, $r_i$, $S_w$, and $S_{g\ crit}$.

Multi-Phase Flow Through Pipes

A second component of a mathematical model consists of a number of mathematical equations describing the flow of gas-oil-water mixture (depending of course on the specifics of each individual well) through a system of pipes connecting the bottomhole area of formation to the surface. In a typical scenario, this is a multi-phase flow system of equations. They are well known in the art and can be found in the publications by Aziz. One such publication is Aziz K. et al. *Pressure Drop in Wells Production Oil and Gas*, Journal of Canadian Petroleum Technology, 1972, incorporated herein in its entirety by reference. Over 30 input fluid parameters are needed for these calculations, which are collected prior to running the model.

Surface Choke Flow Calculations

Gilbert's model was used for simulation of the multi-phase flow of the surface choke. It is known in the art and can be found in the following publication incorporated herein in its entirety by reference: Artificial Lift Methods, Volume, ed. Kermit E. Brown. Main input parameters include P1 and P2 as input and output pressures; GOR—gas-to-oil ratio; D—choke diameter; Q—oil flow rate.

Bottomhole Tool Description and Flow Calculations

Figure 4:
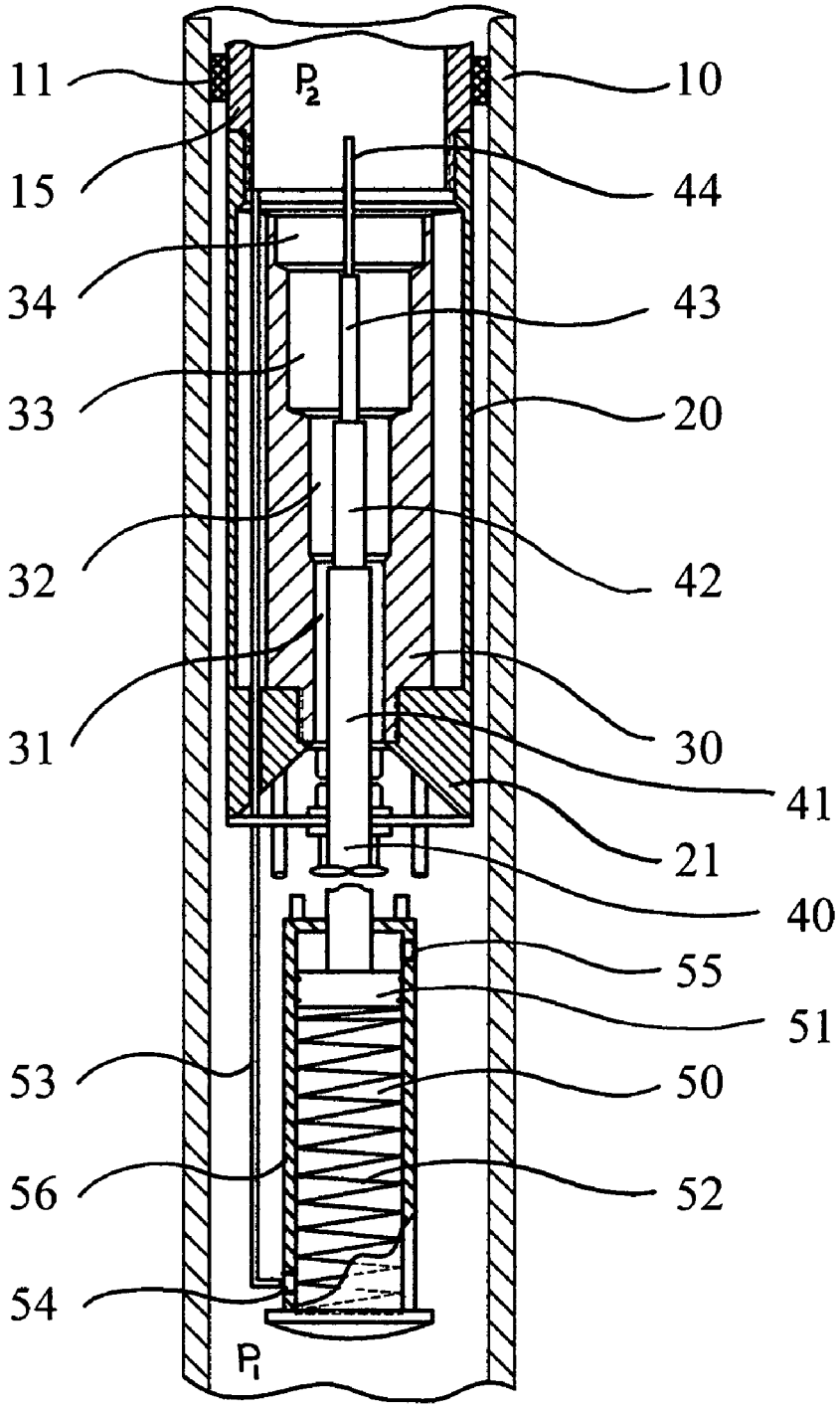
FIG. 4 is a cross-sectional view of the bottomhole tool of the present invention.
Figure 5:
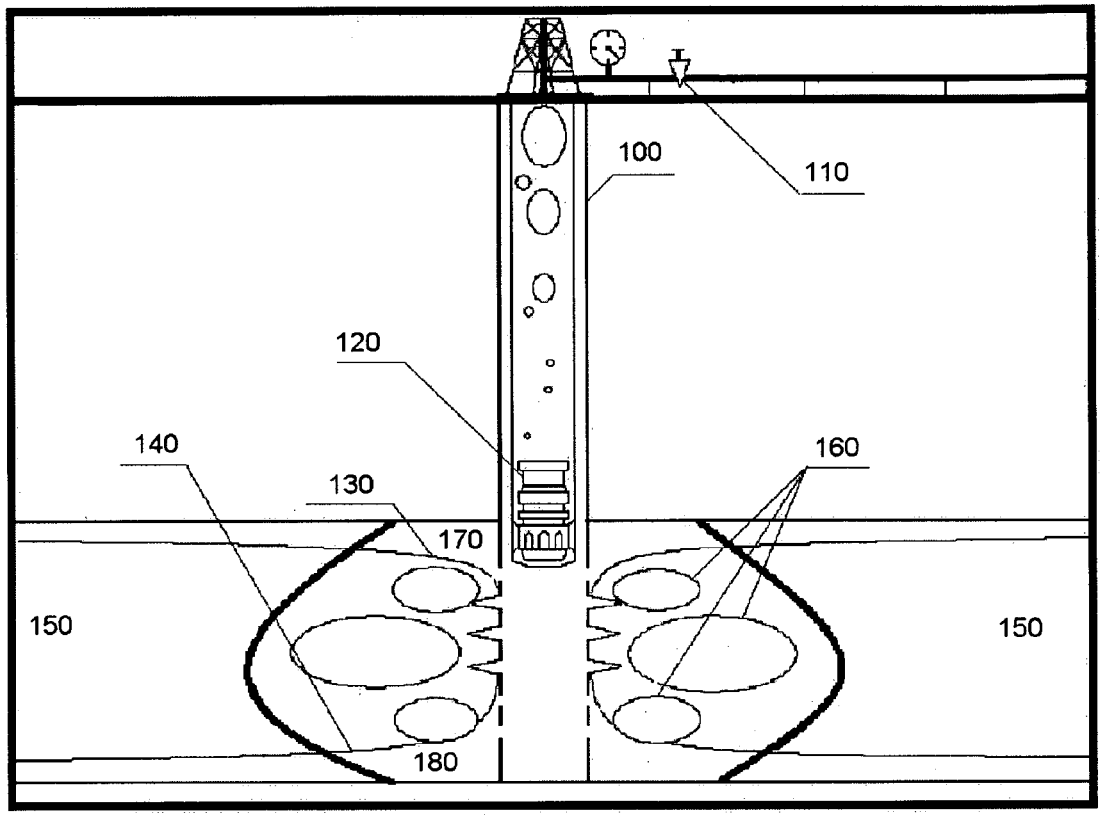
FIG. 5 is an illustration of the negative effects in the near bottomhole zone of the formation.

A detailed description of the device of the present invention follows now with reference to accompanying drawing on FIG. 4 in which like elements are indicated by like reference letters numerals.

The bottomhole tool of the invention is mounted in a well 10 at the end of the pipe 15 sealed to the well 10 through the sealing ring 11. The housing 20 of the tool is attached to the lower end of the pipe 15 by any known means such as by a threaded connection as shown on the drawing. A multi-stage telescopic fluid resistor 30 is attached to the lower portion 21 of the housing 20 and contains cylindrical stages 31, 32, 33, and 34 having diameters decreasing toward the bottom of the device. Although the drawing shows four such stages, it should be understood that any number of stages starting with just two stages is contemplated by the present invention. Provisions are made to direct substantially all fluid flow into the central inside portion of the telescopic fluid resistor 30 through a tapered opening at the bottom of the lower portion 21 of the tool housing 20.

A multi-stage needle 40 is located inside the telescopic fluid resistor 30 and consists of several stages 41, 42, 43, and 44 having diameters increasing in the direction toward the bottom of the tool. These diameters are chosen in such a way that they are all smaller then the diameter of the smallest stage 31 of the resistor 30 so that the needle can travel up and down the entire length of the resistor 30. Preferably, the difference between the largest stage 41 of the needle 40 and the smallest diameter 31 of the resistor 30 is sufficient enough for passing sand and other inclusions so as to prevent well clogging during operation. Exact diameters and lengths of the various stages of the needle 40 and the resistor 30 are calculated from the mathematical model as described herein. Preferably, the ranges of diameters for the needle 40 are between about 1 and about 50 mm, preferably between about 3 and about 20 mm and for the resistor 30 these diameters are between about 2 and about 55 mm, preferably about 4 to about 25 mm. It is also preferred to have the lengths of various stages of the needle 40 correspond to that of the resistor 30. In that case, the flow calculations are well defined to the series of several successive annular passages of well-defined lengths, at least at the lower position of the needle 40.

The needle 40 is supported by and moved up and down as a result of it being connected to a pressure-responsive means consisting of the active piston 51 of the control cylinder 50 responsible for automatic pressure adjustment in the bottomhole tool of the present invention. The housing 56 of the control cylinder 50 is attached to the lower part 21 of the tool housing 20 and is sealed at the bottom. Inside the housing 56 there is located the piston 51 supported by a spring 52 and exposed to two pressures. The first pressure above the piston 51 is that of the bottomhole formation P1, as transmitted through an opening 55. The second pressure is that which acts below the piston 51 and is a pipe pressure P2, as transmitted through a small diameter pipe 53 and the opening 54. The motion of the piston 51 is therefore determined by a pressure differential P2–P1 and the compression of the spring 52. The length of the cylinder 56 is chosen to provide for enough stroke length for moving the needle 40 along the operating range of the resistor 30.

In the beginning of the operation of the bottomhole tool of the invention, the needle 40 is completely introduced inside the resistor 30. In some cases it can be partially introduced, and in other cases it can be completely withdrawn from the lower portion of the resistor 30, depending on the well and formation conditions. After installation of the device and starting of the well, the phase oil permeability, in the near bottomhole zone of the reservoir increases and as a result of that, the oil flow rate increases. In response, the pressure differential within the device grows. The piston 51 is displaced in the cylinder 56, and in turn it displaces the needle 30 downwards. The piston 51 is under a pressure differential P1 minus P2. The position of the piston 51 is balanced by the spring 52 such that the initial movement of the piston 51 connected with the needle 40 starts only when a force generated by the pressure differential exceeds a force of the pre-compressed spring 52.

Before any movement of the piston 51 initiates, the pressure differential within the device corresponds to the initial hydraulic resistance, with the needle 40 seated fully inside the fluid resistor 30. As the oil flow rate reaches a certain point, its further growth may cause an extremely rapid increase of pressure differential within the device, so the needle 40 starts to pull down from the resistor 30. The balancing force of the spring 52 stops the downward movement such that the hydraulic resistance of the device is reduced and the bottomhole pressure is again maintained at a desired level.

When the cylinder needle 40 is completely pulled out of the resistor 30, the hydraulic resistance of the tool is minimal. Such resistance corresponds to a resistance of a system of telescopic pipes having a round cross-section. The pressure differential within the device in response to a further increase of flow rates will be based on a constant (minimal) hydraulic resistance of the lower stage 31 in addition to the next stage 32 and finally to further stages 33 and 34. If the flow rates decrease due to some changes in the reservoir and fluid parameters and reduction of the reservoir pressure, the needle 40 will start moving back up into the body of the resistor 30. This in turn adjusts the hydraulic resistance of the tool to a desired optimum level in order to maintain optimum bottomhole pressure and maximum oil flow rates according to the current conditions of the formation, reservoir pressure, and fluid parameters.

Due to the above described self-regulation of the tool, the device of the present invention can operate efficiently in a wide range of formation, reservoir, and fluid parameters, all varying with time, without the necessity to remove the device from the well. More specifically, formation parameters change during the operation of a well, such as formation pressure, gas, oil and water saturation, phase permeability as well as such fluid parameters as water-oil and gas-oil ratio, viscosity, surface tension, etc. With prior art systems, it was necessary to replace the bottomhole equipment in the well with a new equipment having characteristics corresponding to the current formation and fluid parameters. With the method and device in accordance with the present invention no replacement of the bottomhole equipment is needed. The tool of the invention automatically maintains the desired bottomhole pressure of the formation fluid at the level needed for maintaining the maximum flow of the formation fluid from the bottomhole of the well to the surface wellhead. The device in accordance with the present invention provides automatic adjustment of its parameters in response to the changing formation parameters and fluid properties.

An increased differential pressure between the formation and the bottomhole pressure usually results in increased oil flow rates. However, in formations with high gas-oil ratio, a decrease in bottomhole pressure causes formation oil degassing in the near bottomhole zone of the formation, increase in oil viscosity, reduction of the formation oil permeability and as a result, reduction of the formation productivity. Further reduction of bottomhole pressure may result in a decrease of oil flow rate rather than its increase. The optimum pressure will change in time according to change of parameters of fluid and formation. Maintenance of an optimum bottomhole pressure by means of the inventive device in the formations with gas and water coning provides for the maximum oil flow rates with minimum gas and water flow rates.

The following publications contain mathematical equations used to calculate the flow through the bottomhole tool of the invention, all of which are incorporated herein in their entirety by reference:

*Two-phase flow in vertical noncircular channels*, International Journal of Multiphase Flow, vol. 8, 1982, pp 641–655;

*Sudden Contraction Losses in Two-phase Flow.*, Journal of Heat Transfer, February 1966; and

*Some Characteristics of Gas-Liquid Flow in Narrow Rectangular Ducts*, International Journal of Multiphase Flow, vol. 19, No. 1 ,1991, pp. 115–125.

Figure 1:
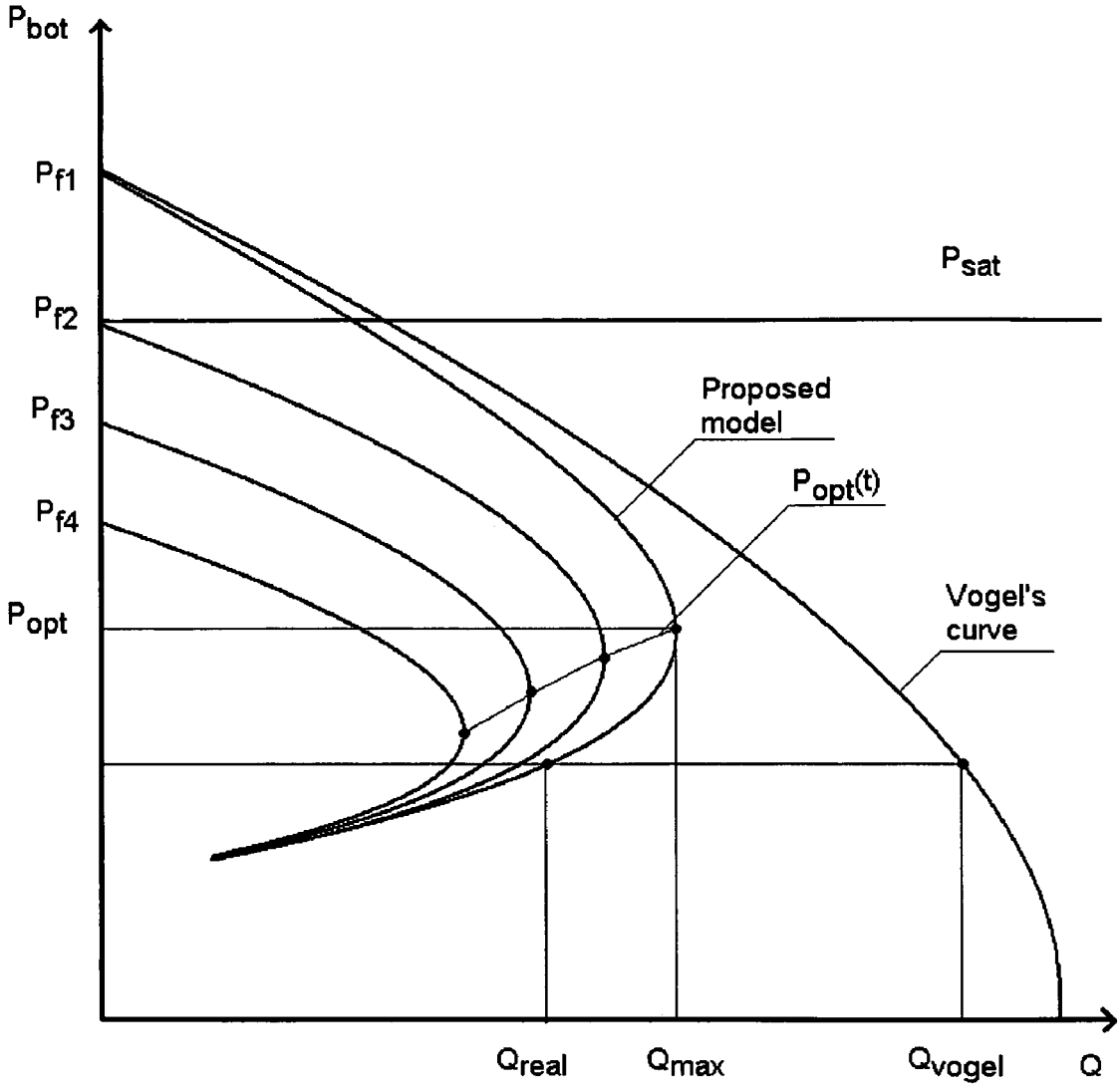
FIG. 1 is an inflow performance relationship curve according to Vogel and according to the present invention.

The method of the invention consists therefore of several steps in defining and maintaining the optimum level of bottomhole pressure in order to maximize oil production:

a) collecting formation and oil well input data, such as on the current conditions of the well, bottomhole zone, fluid and reservoir parameters, PVT, geometry and dimensions of pipes, bottomhole tool and a wellhead surface choke and so on to populate the mathematical model describing "formation—multi-phase flow—surface choke—bottomhole tool" behavior;

b) modeling or simulating the entire Inflow Performance Relationship curve describing the relationship of the bottomhole pressure and the oil production rate similar in general to that shown on FIG. 1 but specific to a particular well;

c) calculating the desired higher than zero value of the bottomhole pressure from the IPR curve as calculated in step (b);

d) adjusting the bottomhole pressure to the vicinity of the desired level corresponding to current well conditions by any number of available means including performing a gas lift, adjusting the bottomhole choke of the generally known design or inserting an appropriately sized bottomhole tool of the invention;

e) in case the bottomhole tool of the invention is used, conducting final adjustment of the bottomhole pressure by adjusting the wellhead surface choke and thereby the pressure above the bottomhole tool of the invention;

f) starting oil fluid flow and monitoring well parameters to be within the desired levels to ensure maximum oil flow rate as well as compare the actual flow rate to that predicted by the model, adjust the model if necessary;

g) if deviation of the well parameters is detected, recalculating the optimum bottomhole pressure and adjust it according to newly calculated value using the previously described steps;

h) maintaining the bottomhole pressure at the optimum level so that the oil flow rate is maximized throughout the life of the well or the operation of the device of the invention.

Example of Using the Method of Invention

As an example, the following formation was analyzed and mathematical model was calculated for: radius $R_f$=1000 ft; height H=50 ft; Φ=0.15; K=15 μD, $r_w$=0.3 ft, with PVT characteristics shown on FIG. 2 and functions $K_{ro}(S_L)$ and $K_{rg}(S_L)$ shown on FIG. 3. Extraction method was regime solution gas. Illustrative data, results and charts are shown on FIGS. 6–8.

Figure 6:
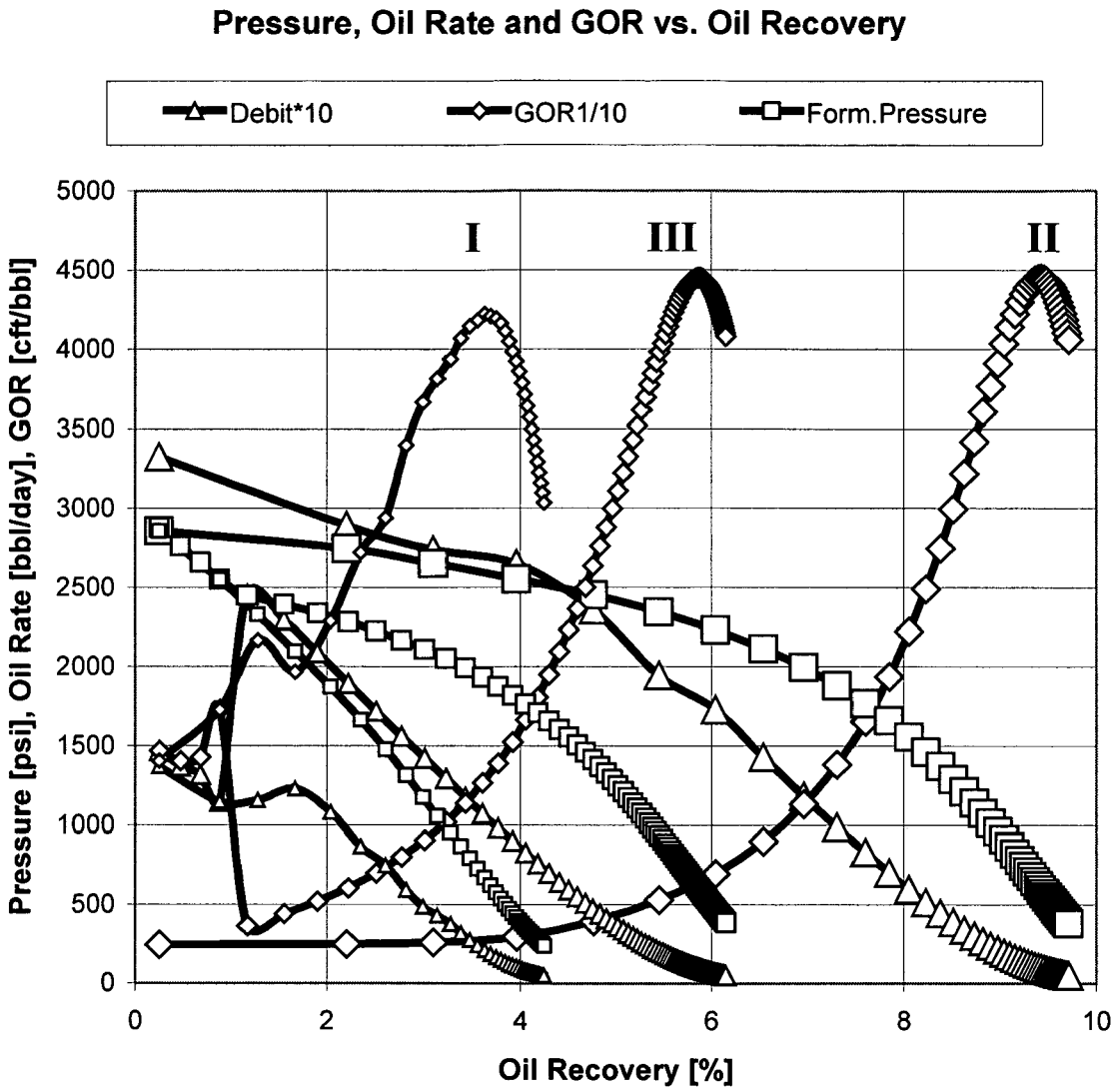
FIG. 6 is a mathematical model chart showing the formation pressure, oil rate and GOR curves as a function of oil recovery.

The resulting three cases of solution are shown on FIG. 6:

Case I—the case when bottomhole pressure was kept throughout the life of the well at a non-optimal level of $P_{bot}(t)=0.25\cdot P_f(t)$;

Case II—the case when bottomhole pressure was kept throughout the life of the well at an optimum level of $P_{bot}(t)=P_{bot}^{opt}(t)$; and Case III—the case when at first for approximately 120 days the well worked according to scenario as in case I, and then it was switched to scenario as in case II.

Behaviors of oil rate ($Q_{oil}$), formation pressure ($P_f$), and GOR, in dependence of current recovery index (N) are shown on FIG. 6 as predicted by using the calculations according to the method of the present invention. In case I, the well worked for approximately 990 days before the oil rate fell to 6 bar/day, the limit of production sensibility. By that time, the well gave approximately 4.25% of the ultimate recovery index. In the second case, the well worked for 1440 days (4 years), and gave approximately 9.8% of the ultimate recovery index, more than double that of the first case. In case III (see FIG. 7), when the well was switched to optimal regime 120 days after production started, the ultimate oil recovery index increased from about 4.25% to about 6.2%. At the same time, switching the well into optimal regime reduced GOR and increased oil rate from 130 bar/day to 250 bar/day. The lifetime of the oil well in that case is increased to about 3.4 years.

Figure 7:
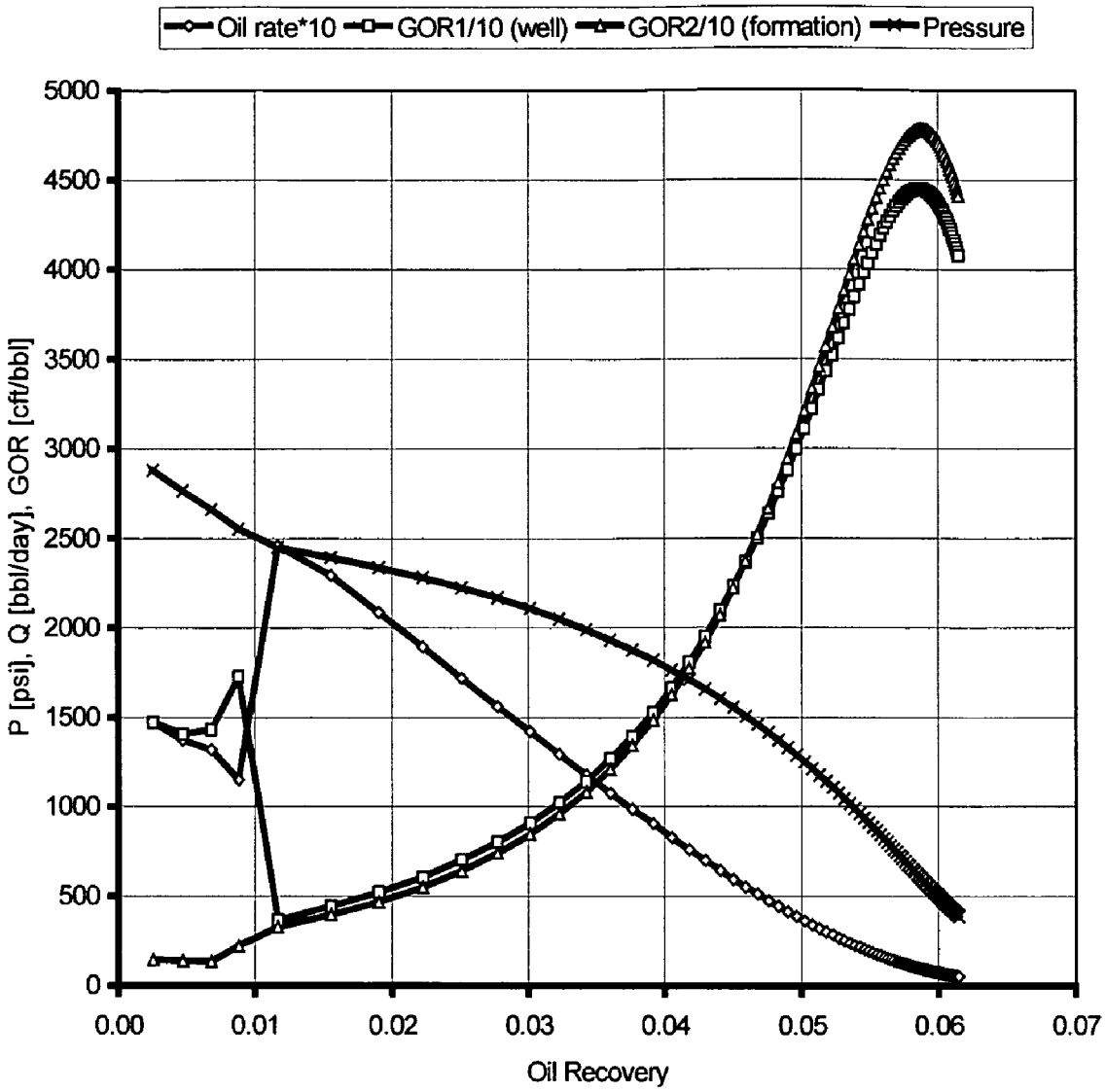
FIG. 7 illustrates a mathematically modeled well performance in a given period of time.

All these desirable effects were achieved due to keeping the bottomhole pressure at the optimal higher than zero level, which caused reduction of forming of oil blocking zone in formation near bottomhole and slowed down loss of gas from formation, which in turn may cause formation pressure to drop. FIGS. 6 and 7 also illustrate that maintaining the bottomhole pressure at the optimum level as calculated using the method of the invention substantially increases the ultimate oil recovery from a given well.

Figure 8:
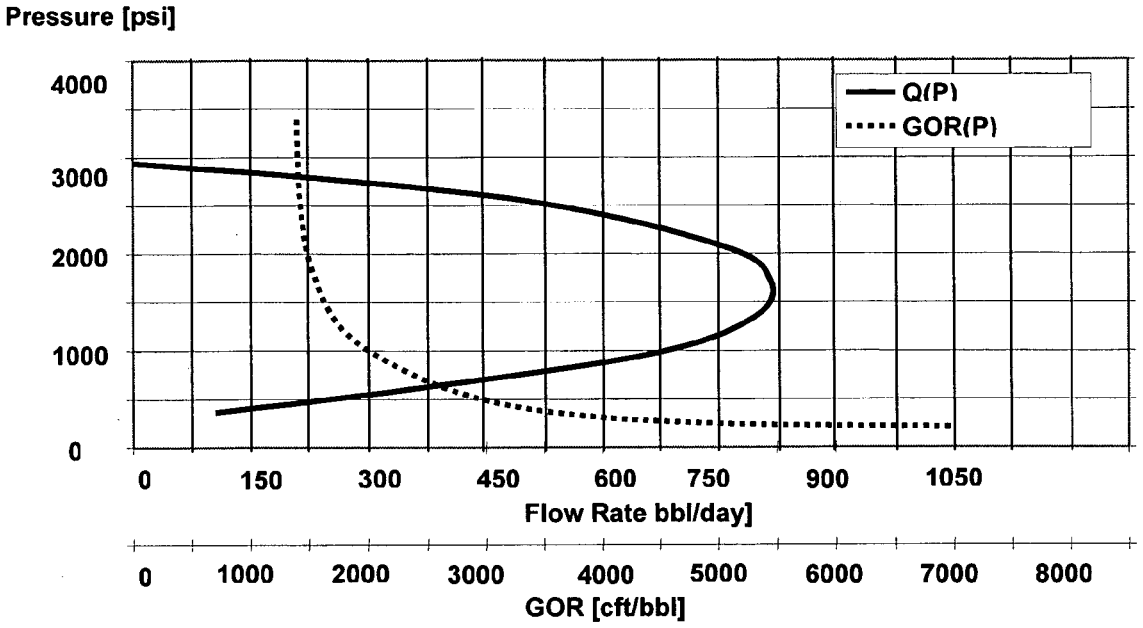
FIG. 8 is a mathematical model of a sample IPR curve.
Figure 9:
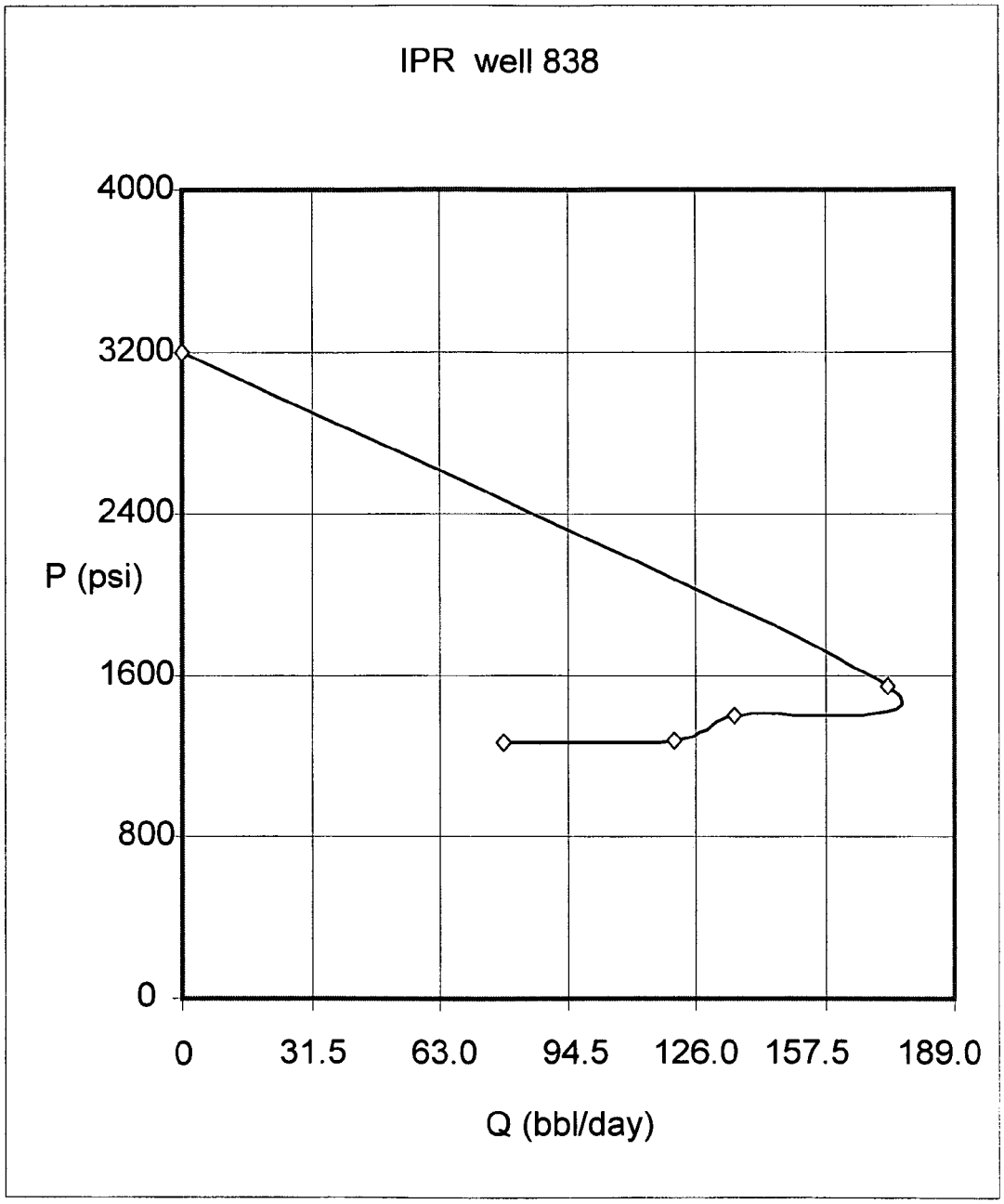
FIG. 9 illustrates the actual IPR curve with a peak oil recovery rate visible on the chart.

FIG. 8 shows a calculated IPR curve for an oil well with formation parameters amenable to using the method of the present invention. The presence of the optimum value of the bottomhole pressure is seen which is not equal to zero. That bottomhole pressure corresponds to the maximum oil production rate for these formation and oil well conditions. Also of note is the strong tendency of GOR to increase with bottomhole pressures falling below the optimum level.

Besides the obvious benefit of increasing the oil flow rate and oil recovery index from the well, the method and device of the invention provide for the following important advantages:

reduce gas-to-oil ratio and water-to-oil ratio and therefore gas and water content of the upcoming fluid from a well;

reduce or eliminate the gas and water cones;

reduces the risk of forming areas near the bottomhole zone with high viscosity fluids;

extends the life of the formation and extends the time of its depletion;

increases the index of oil production for a particular formation or well;

increases the stability of oil production;

increases the efficiency of gas lift and pumping operations;

reduces the pumping electrical energy costs and other costs associated with oil production;

reduces the undesirable washout of sand and other particles from the formation.

Although the invention herein has been described with respect to particular embodiments, it is understood that these embodiments are merely illustrative of the principles and applications of the present invention. In particular, the needle of the bottomhole tool may be activated indirectly by providing a gear reducer between the piston and the needle body, as well as the spring may be located outside or even below the cylinder. It is therefore to be understood that numerous modifications may be made to the illustrative embodiments and that other arrangements may be devised without departing from the spirit and scope of the present invention as defined by the appended claims.

What is claimed is:

1. A method for optimizing oil production rate and overall oil recovery from a formation having an oil well, comprising following steps:

a) collecting formation and oil well input data;

b) calculating Inflow Performance Relationship curve from said formation and oil well input data to describe the projected relationship of a bottomhole formation pressure and an oil production rate;

c) identifying a higher than zero desired value of said bottomhole pressure corresponding to a maximum oil production rate from said calculated Inflow Performance Relationship curve under current well conditions;

d) adjusting the bottomhole pressure to the vicinity of said desired bottomhole pressure corresponding to current well conditions;

e) starting oil production flow;

f) monitoring oil well parameters to be within the collected formation and oil well input data values;

g) if deviation of the well parameters from the collected formation input data is detected, repeating steps (a) through (c) to recalculate the desired value of said bottomhole pressure; and h) adjusting the bottomhole pressure to said newly calculated desired value.

2. The method as in claim 1, wherein said oil well further comprising a bottomhole tool and a wellhead surface choke, said step (a) includes collecting formation input data including current conditions of said oil well, bottomhole zone, fluid and reservoir parameters, PVT, geometry and dimensions of pipes, bottomhole tool and a wellhead surface choke to populate a mathematical model describing "formation—multi-phase flow—surface choke—bottomhole tool" behavior.

3. The method as in claim 2, wherein said step (d) of adjusting said bottomhole pressure includes adjusting said bottomhole tool.

4. The method as in claim 3, wherein said step (d) further includes conducting a final adjustment of said bottomhole pressure by adjusting said wellhead surface choke to change the pressure above said bottomhole tool.

5. The method as in claim 1, wherein said step (d) of adjusting said bottomhole pressure is achieved by performing a gas lift.

6. The method as in claim 1, further including a step (i) of maintaining said bottomhole pressure at a desired level throughout the life of said well, whereby maximum overall oil recovery is achieved.

7. A bottomhole tool for adjusting a bottomhole pressure in an oil well containing a pipe between a bottomhole zone and a wellhead, said tool comprising:

a tool housing attached to said pipe in said bottomhole zone of said oil well, a multi-stage telescopic fluid resistor contained in said tool housing, a multi-stage needle located inside said telescopic fluid resistor, and a pressure-responsive means to move said needle in and out of said telescopic fluid resistor, said pressure-responsive means including a spring-biased piston attached to said needle and located in a control cylinder attached to said housing, said piston exposed to said bottomhole pressure above thereof and a pipe pressure below thereof, whereby said needle is maintained at a position defined by a difference between said bottomhole pressure and said pipe pressure and said spring, said needle defining with said telescopic fluid resistor a series of successive annular passages for oil flow therethrough.

8. The bottomhole tool as in claim 7, wherein said multi-stage telescopic flow resistor has a number of stages equal to same of said multi-stage needle.

9. The bottomhole tool as in claim 7, wherein said pipe is sealed against said well.

10. The bottomhole tool as in claim 7, wherein said telescopic fluid resistor having a succession of cylindrical stages with resistor diameters decreasing towards the bottomhole zone of said oil well.

11. The bottomhole tool as in claim 10, wherein said resistor diameters are between 2 and 55 mm.

12. The bottomhole tool as in claim 11, wherein said resistor diameters are between 4 and 25 mm.

13. The bottomhole tool as in claim 10, wherein said multi-stage needle having a succession of cylindrical stages with needle diameters increasing towards the bottomhole zone of said oil well.

14. The bottomhole tool as in claim 13, wherein said needle diameters are between about 1 and about 50 mm.

15. The bottomhole tool as in claim 14, wherein said needle diameters are between about 3 and about 20 mm.

16. The bottomhole tool as in claim 7, wherein the largest diameter of said multi-stage needle is smaller than the smallest diameter of said telescopic resistor.

17. The bottomhole tool as in claim 7 further including a gear reducer between said multi-stage needle and said piston.

18. A method for optimizing oil production rate and overall oil recovery from a formation having an oil well containing a pipe between a bottomhole zone and a wellhead, comprising following steps:

a) providing a bottomhole tool comprising a tool housing attached to said pipe in said bottomhole zone of said oil well, a multi-stage telescopic fluid resistor contained in said tool housing, a multi-stage needle located inside said telescopic fluid resistor, and a pressure-responsive means to move said needle in and out of said telescopic fluid resistor, said pressure-responsive means exposed to said bottomhole pressure and a pipe pressure, b) collecting formation and oil well input data;

c) calculating Inflow Performance Relationship curve from said formation and oil well input data to describe the projected relationship of a bottomhole formation pressure and an oil production rate;

d) identifying a higher than zero desired value of said bottomhole pressure corresponding to a maximum oil production rate from said calculated Inflow Performance Relationship curve under current well conditions;

e) adjusting the bottomhole pressure to the vicinity of said desired bottomhole pressure corresponding to current well conditions;

f) starting oil production flow;

g) monitoring oil well parameters to be within the collected formation and oil well input data values;

h) if deviation of the well parameters from the collected formation input data is detected, repeating steps (a) through (c) to recalculate the desired value of said bottomhole pressure; and i) adjusting the bottomhole pressure to said newly calculated desired value.

19. The method as in claim 18, wherein said step (e) of adjusting said bottomhole pressure includes adjusting a pressure at said wellhead to cause a predetermined response thereto of said bottomhole tool to bring said bottomhole pressure to said desired value.

* * * * *